US012102169B2

(12) United States Patent
Coupe et al.

(10) Patent No.: US 12,102,169 B2
(45) Date of Patent: Oct. 1, 2024

(54) CHASSIS SYSTEM FOR FOOTWEAR

(71) Applicant: Genesco Inc., Nashville, TN (US)

(72) Inventors: Cameron Coupe, Nashville, TN (US); Jason Clifton, Nashville, TN (US)

(73) Assignee: GENESCO INC., Nashville, TN (US)

( * ) Notice: Subject to any disclaimer, the term of this patent is extended or adjusted under 35 U.S.C. 154(b) by 252 days.

(21) Appl. No.: 17/126,918

(22) Filed: Dec. 18, 2020

(65) Prior Publication Data

US 2022/0192315 A1 Jun. 23, 2022

(51) Int. Cl.
*A43B 13/12* (2006.01)
*A43B 13/16* (2006.01)
*A43B 13/37* (2006.01)

(52) U.S. Cl.
CPC ..... *A43B 13/125* (2013.01); *A43B 13/122* (2013.01); *A43B 13/16* (2013.01); *A43B 13/37* (2013.01)

(58) Field of Classification Search
None
See application file for complete search history.

(56) References Cited

U.S. PATENT DOCUMENTS 130,805 A 8/1872 Hunter
3,902,259 A * 9/1975 Cracco ..... A43B 3/24 36/11.5
4,635,384 A 1/1987 Huh et al.
4,747,220 A * 5/1988 Autry ..... A43B 13/26 36/114
5,771,606 A * 6/1998 Litchfield ..... A43B 13/203 36/71
5,987,783 A 11/1999 Allen et al.
6,038,790 A 3/2000 Pyle et al.
6,065,229 A * 5/2000 Wahrheit ..... A43B 7/1425 36/31
6,145,220 A 11/2000 Johnson, Jr. et al.
6,176,025 B1 * 1/2001 Patterson ..... A43B 7/1445 36/35 B
6,209,226 B1 * 4/2001 Squadroni ..... A43B 7/08 36/141
6,345,454 B1 * 2/2002 Cotton ..... A43B 3/24 36/15
6,497,057 B1 12/2002 Lee et al.
(Continued)

OTHER PUBLICATIONS

U.S. Appl. No. 15/837,030, Non-Final Office Action, Apr. 19, 2019, 9 pages.

(Continued)

*Primary Examiner* — Jila M Mohandesi
(74) *Attorney, Agent, or Firm* — Kilpatrick Townsend & Stockton LLP

(57) ABSTRACT

An article of footwear includes a chassis, and the chassis includes a body having a toe end, a heel end, a top surface, and a bottom surface. A distance from the top surface to the bottom surface is a thickness of the chassis, and the body defines a perimeter of the chassis. The chassis may include an aperture within the perimeter of the chassis that extends through the thickness of the chassis. A center region of the body between the toe end and the heel end may include a cored region having a cavity defined in the top surface of the body and at least one vertical support within the cavity. In some aspects, the body includes a non-uniform thickness.

19 Claims, 15 Drawing Sheets

(56) References Cited

U.S. PATENT DOCUMENTS

| | | | | |
|---|---|---|---|---|
| 7,168,187 | B2 | 1/2007 | Robbins et al. | |
| 7,249,425 | B2 | 7/2007 | Wang | |
| 7,380,353 | B2 | 6/2008 | Feller et al. | |
| 7,640,681 | B2 * | 1/2010 | Yang | A61F 5/14 36/141 |
| 7,832,118 | B2 * | 11/2010 | Holden | A43B 21/28 36/35 R |
| 8,307,571 | B1 * | 11/2012 | Ceylan | A43B 21/42 36/101 |
| 8,327,559 | B2 * | 12/2012 | Berger | A43B 13/16 36/103 |
| 9,021,721 | B2 | 5/2015 | Mccarron | |
| 9,737,109 | B2 * | 8/2017 | Johnson | A43B 3/244 |
| 9,770,066 | B2 | 9/2017 | Grelle et al. | |
| 9,814,280 | B2 | 11/2017 | Buck, IV et al. | |
| 9,883,713 | B2 * | 2/2018 | Kawakami | A43B 3/24 |
| 9,955,748 | B2 * | 5/2018 | Grove | A43B 13/26 |
| 9,955,749 | B2 * | 5/2018 | Van Atta | A43B 7/148 |
| 10,010,135 | B2 | 7/2018 | Lovell et al. | |
| 10,264,847 | B2 | 4/2019 | Oloff | |
| 10,383,394 | B2 * | 8/2019 | Dombrow | A43B 13/187 |
| 10,531,700 | B2 * | 1/2020 | Johnson | A43B 13/36 |
| 11,559,103 | B2 * | 1/2023 | McMahon Tumpson | A43B 7/38 |
| 2002/0017036 | A1 * | 2/2002 | Berger | A43B 7/08 36/31 |
| 2002/0133980 | A1 | 9/2002 | Pan | |
| 2003/0200675 | A1 * | 10/2003 | Gross | A43B 13/36 36/15 |
| 2004/0181970 | A1 | 9/2004 | Covatch | |
| 2006/0168847 | A1 * | 8/2006 | Myers | A43B 7/125 36/103 |
| 2006/0213091 | A1 * | 9/2006 | Ometto | A43B 17/08 36/141 |
| 2008/0168684 | A1 | 7/2008 | Khalifa | |
| 2009/0019730 | A1 | 1/2009 | Salminen et al. | |
| 2009/0056172 | A1 | 3/2009 | Cho | |
| 2009/0126230 | A1 * | 5/2009 | McDonald | A43B 3/246 36/103 |
| 2010/0107448 | A1 * | 5/2010 | Fallow | A43B 5/12 36/103 |
| 2010/0126044 | A1 * | 5/2010 | Davis | A43B 7/144 36/43 |
| 2011/0061269 | A1 | 3/2011 | Nakano | |
| 2011/0126422 | A1 | 6/2011 | Vattes et al. | |
| 2011/0154693 | A1 | 6/2011 | Oberschneider | |
| 2012/0017467 | A1 | 1/2012 | Whitney et al. | |
| 2013/0067765 | A1 * | 3/2013 | Auger | A43B 23/22 36/31 |
| 2013/0205616 | A1 * | 8/2013 | Grove | A43B 3/244 36/15 |
| 2014/0075777 | A1 * | 3/2014 | Bruce | A43B 7/148 36/29 |
| 2014/0075779 | A1 | 3/2014 | Bruce et al. | |
| 2014/0182169 | A1 | 7/2014 | Mack | |
| 2015/0020414 | A1 * | 1/2015 | Mulholland | A43B 1/0081 36/100 |
| 2017/0079373 | A1 | 3/2017 | Huard et al. | |
| 2017/0340053 | A1 | 11/2017 | Madore | |
| 2018/0160768 | A1 | 6/2018 | Clifton et al. | |
| 2018/0160771 | A1 | 6/2018 | Clifton et al. | |

OTHER PUBLICATIONS

U.S. Appl. No. 15/837,030, Restriction Requirement, Feb. 8, 2019, 8 pages.

U.S. Appl. No. 15/837,041, Non-Final Office Action, May 31, 2019, 28 pages.

* cited by examiner

CHASSIS SYSTEM FOR FOOTWEAR

FIELD OF THE INVENTION

This application relates to articles of footwear, and more particularly to support systems for articles of footwear.

BACKGROUND

Footwear comes in many forms and may be worn by a person depending on their preference or requirements in a certain situation. While footwear serves the basic purpose of covering or protecting the wearer's foot, it may be desirable incorporate stylish features into such footwear. Traditionally, to achieve such stylish features, it has been necessary to construct the shoes of rigid durable materials to provide a high degree of support. However, such materials may be uncomfortable to wear and/or require many different materials to form the complete article of footwear.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, an article of footwear includes a chassis and an midsole. The chassis includes a body with a toe end, a heel end, a top surface, and a bottom surface. The body defines a perimeter of the chassis, and a distance from the top surface to the bottom surface is a thickness of the chassis. The chassis also includes an aperture within the perimeter of the chassis that extends through the thickness of the chassis. The midsole is attached to the chassis and includes a top surface and a bottom surface. The bottom surface may be an outer surface of the article of footwear that is configured to engage a ground surface when worn by a user. In some embodiments, the top surface includes a raised region, and the raised region of the top surface is received within the aperture of the chassis such that the raised region of the top surface is flush with the top surface of the body.

According to various embodiments, an article of footwear includes a chassis, and the chassis includes a body with a toe end, a heel end, a top surface, and a bottom surface. A distance from the top surface to the bottom surface is a thickness of the chassis, and the body defines a perimeter of the chassis. The chassis also may include an aperture within the perimeter of the chassis that extends through the thickness of the chassis. In various embodiments, the body has a non-uniform thickness, and the thickness of a center region of the body between the toe end and the heel end may be greater than the thickness of the body proximate to the toe end and greater than the thickness of the body proximate to the heel end.

According to certain embodiments, an article of footwear includes a chassis, and the chassis includes a body with a toe end, a heel end, a center region between the toe end and the heel end, a top surface, and a bottom surface. A distance from the top surface to the bottom surface is a thickness of the chassis, and the body defines a perimeter of the chassis. In certain embodiments, the center region of the body includes a cored region that includes a cavity defined in the top surface and at least one vertical support within the cavity.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others are intended to refer to the orientation as illustrated and described in the figure (or figures) to which the components and directions are referencing.

Described herein is an article of footwear that includes a chassis. While the articles of footwear are illustrated as dress shoes, they are by no means so limited. Rather, articles of footwear that include a chassis may be any type of article of footwear as desired, including but not limited to dress footwear, casual footwear, athletic footwear, footwear for men, footwear for women, footwear for children, or otherwise as desired.

Compared to existing articles of footwear, articles of footwear with the chassis described herein may have a simplified construction, provide improved support to a wearer, and provide improved comfort or cushioning to the wearer. In one example, articles of footwear with the chassis may provide a construction with a reduced number of layers and components compared to existing shoes. As a non-limiting example, the article of footwear with the chassis may have a three or four layer construction (e.g., upper, chassis, midsole, and optionally outsole) compared to existing articles of footwear. In certain embodiments, the chassis may minimize and/or eliminate support structures extending beneath the heel and/or ball of the wearer's foot while still providing stability to the shoe. The chassis may also allow the wearer's foot to directly engage and/or otherwise stand directly on the midsole and/or other material for increased comfort. In some examples, the chassis may provide a support structure that has improved flexibility in certain portions (including but not limited to a forefront of the article of footwear) while also providing improved support and/or reduced flexibility in other portions (including but not limited to a middle or arch portion of the article of footwear). In certain embodiments, the chassis may act as a welt that is used to bond the upper of the article of footwear to the midsole of the article of footwear. In various embodiments, the chassis may have a reduced thickness while providing improved stabilization to the article of footwear.

Figure 1:
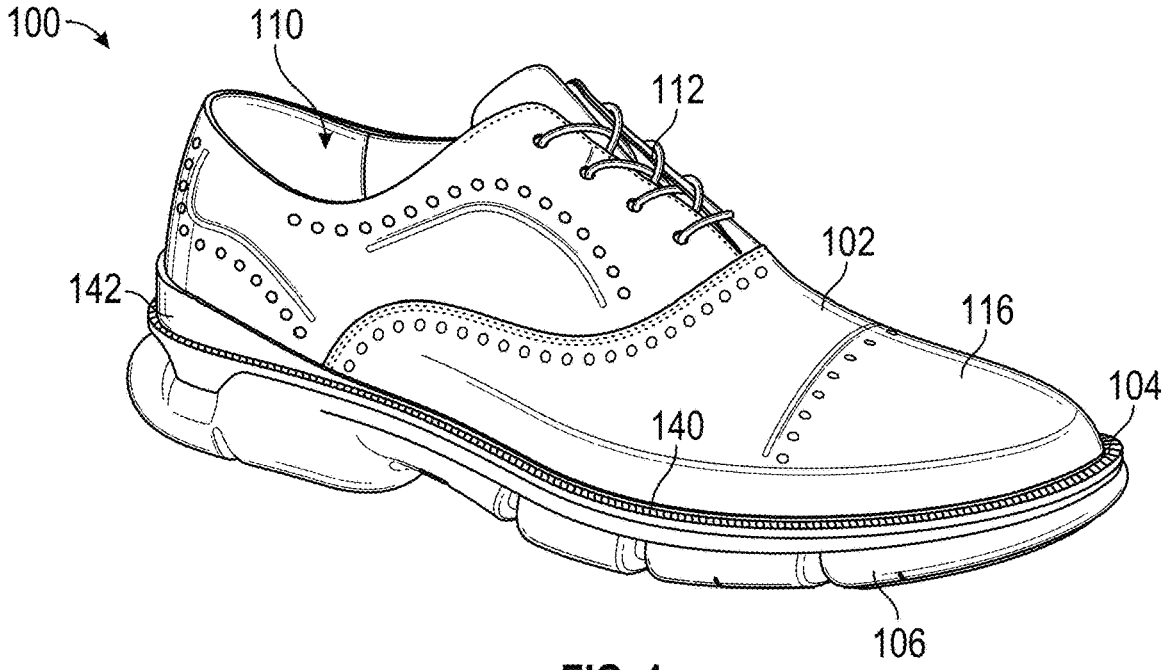
FIG. 1 is a perspective view of an article of footwear according to various embodiments.
Figure 2:
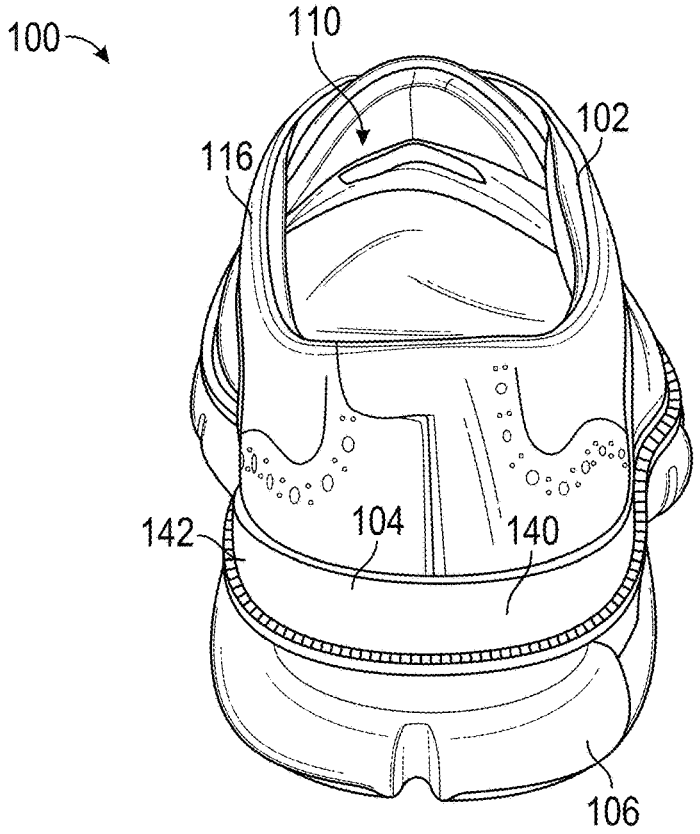
FIG. 2 is an end view of the article of footwear of FIG. 1.
Figure 3:
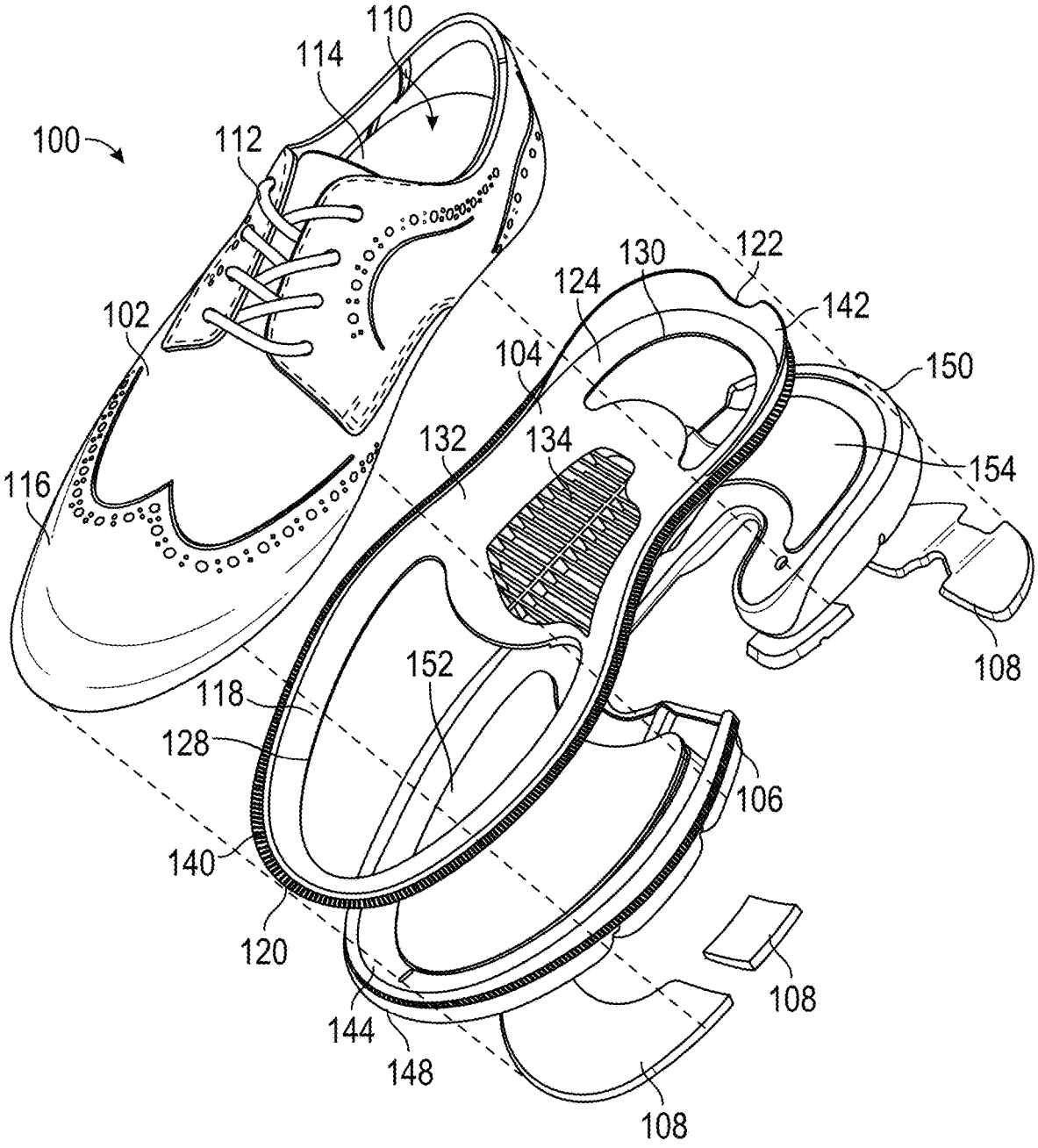
FIG. 3 is an exploded view of the article of footwear of FIG. 1.

FIGS. 1-20 illustrate an article of footwear 100 according to various embodiments. As best illustrated in FIGS. 1-3, the article of footwear 100 includes an upper 102, a chassis 104, and an midsole 106. Optionally, the article of footwear 100 may include an outsole 108.

The upper 102 includes an outer surface 116 and may generally define a receiving area 110 that at least partially receives a foot of a wearer when the article of footwear 100 is worn. The upper 102 may optionally include one or more adjusters 112 such that the size of the receiving area 110 and/or the fit of the upper 102 on the foot of the wearer can be adjusted as desired. In the embodiment illustrated, the adjuster 112 is a shoelace. Optionally, a foot bed 114 may be removably positioned within the receiving area 110 (e.g., it can be removed as desired) that may provide supplemental cushioning and/or support to the wearer as desired. Depending on the type of article of footwear 100, the upper 102 may have various shapes, configurations, and features as desired, and the upper 102 illustrated should not be considered limiting. Likewise, the adjuster(s) 112 and/or the foot bed 114 may be various suitable features or materials as desired.

The chassis 104 of the article of footwear 100 is a support structure that may provide support and/or stability along the entire length of the article of footwear 100. The chassis 104 may be constructed from various materials as desired, including, but not limited to thermoplastic polyurethane, thermoplastic elastomers, carbon fiber, a material fused with carbon fiber, injected plastics, thermoplastic rubbers, latex rubbers, dual density polyurethane, natural rubbers, elastomers, ethylene vinyl acetate (EVA), biobased content, biomass, biobased intermediate, bioresins, biopolymers, biobased and/or renewable chemicals. reclaimed material, post-consumer material, pre-consumer/post-industrial material, combinations thereof, or other suitable materials as desired. In various examples, the chassis 104 has a durometer of from about 30 Asker C to about 100 Shore D, such as from about 50 Shore A to about 100 Shore D, such as from about 80 Shore A to about 100 Shore D, such as from about 80 Shore A to 100 Shore A, such as from about 30 Asker C to about 95 Shore A. In various examples, the chassis 104 may have a durometer that is greater than that of the midsole 106. The chassis 104 may be formed through various manufacturing techniques such as molding, injection, compression, one shot, casting, forming, and various other suitable techniques.

In various embodiments, the chassis 104 includes a body 118 having a toe end 120, a heel end 122 opposite from the toe end 120, an upper surface 124, and a lower surface 126 opposite from the upper surface 124. The body 118 defines a perimeter of the chassis 104. The shape and size of the perimeter formed by the body 118 should not be considered limiting, and in various examples, the perimeter formed by the body 118 may have a particular shape and/or size depending on a type or style of the article of footwear 100. A distance from the upper surface 124 to the lower surface 126 is a thickness of the chassis 104, and a direction extending from the toe end 120 to the heel end 122 is a length of the chassis 104.

A center region 132 of the body 118 having the upper surface 124 and the lower surface 126 is between the toe end 120 and the heel end 122. In some embodiments, and as best illustrated in FIGS. 15-20, the chassis 104 may have a non-uniform thickness along its length. In certain embodiments, the thickness of the center region 132 of the body 118 may be greater than at least the thickness of the body 118 proximate to the toe end 120. In one non-limiting example, the thickness of the center region 132 may be about 6.0 mm, and the thickness of the body 118 proximate to the toe end 120 may be about 3.0 mm. As another non-limiting example, the thickness of the center region 132 may be about 6.0 mm, and the thickness of the body 118 proximate to the toe end 120 may be about 1.5 mm. In other embodiments, the thickness of the center region 132 may be less than 6.0 mm or greater than 6.0 mm, and likewise the thickness of the body 118 proximate to the toe end 120 may be less than 1.5 mm, between 1.5 mm and 3.0 mm, and/or greater than 3.0 mm.

In some embodiments, the thickness of the center region 132 of the body 118 may be greater than the thickness of the body 118 proximate to the heel end 122. As one non-limiting example, the thickness of the center region 132 may be about 6.0 mm, and the thickness of the body 118 proximate to the heel end 122 may be about 3.0 mm. As another non-limiting example, the thickness of the center region 132 may be about 6.0 mm, and the thickness of the body 118 proximate to the heel end 122 may be about 1.5 mm. In other embodiments, the thickness of the body 118 proximate to the heel end 122 may be less than 1.5 mm, between 1.5 mm and 3.0 mm, and/or greater than 3.0 mm. In other embodiments, the thickness of the center region 132 need not be greater than the thickness of the body 118 proximate to the heel end 122. In various embodiments, the chassis 104 with the non-uniform thickness may provide improved flexibility to certain regions of the article of footwear 100 (e.g., a forefoot region where the chassis is thinner) and improved stability in other regions of the article of footwear 100 (e.g., a heel region and/or an arch region where the chassis is thicker) to provide improved comfort and support to the wearer when the article of footwear 100 is worn. In this way, the non-uniform thickness of the chassis promotes flexion in desired areas (e.g., a forefront region) and stability in others (e.g., an arch and/or heel region), providing an "adaptive flex" or adaptive support system for the article of footwear 100. Because the chassis 104 is designed to provide flexibility at the forefront region and stability in an area that supports the arch of a wearer's foot, the chassis 104 eliminates the need for various layers otherwise required to provide the requisite rigidity/stability and also eliminates the need for a separate metal (or other rigid) shank piece that would otherwise be required to provide rigidity/support in an article of footwear with a heel.

Figure 4:
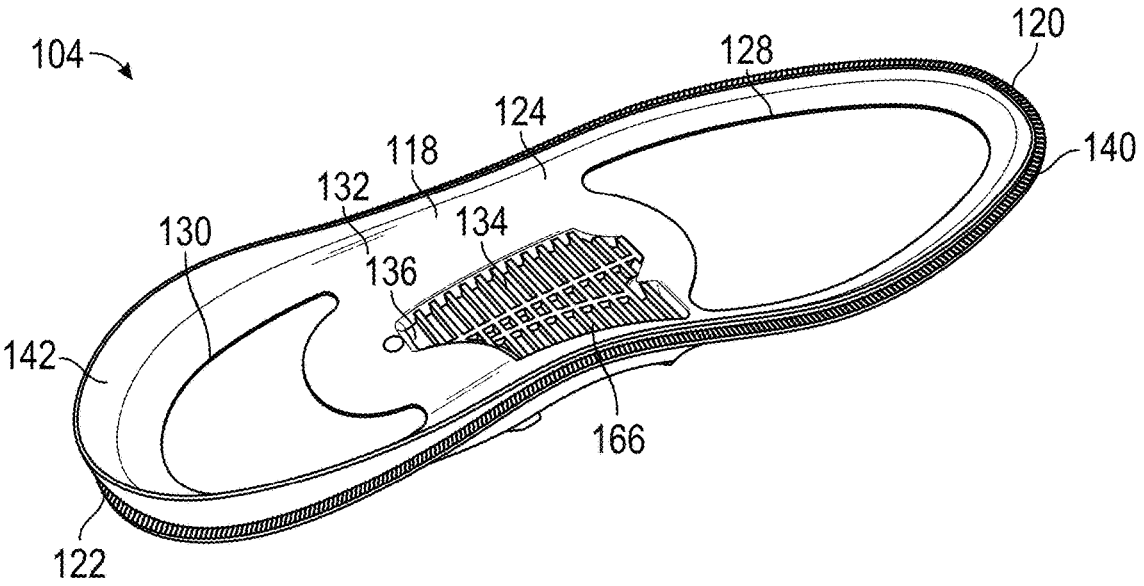
FIG. 4 is a top perspective view of a chassis of the article of footwear of FIG. 1.
Figure 5:
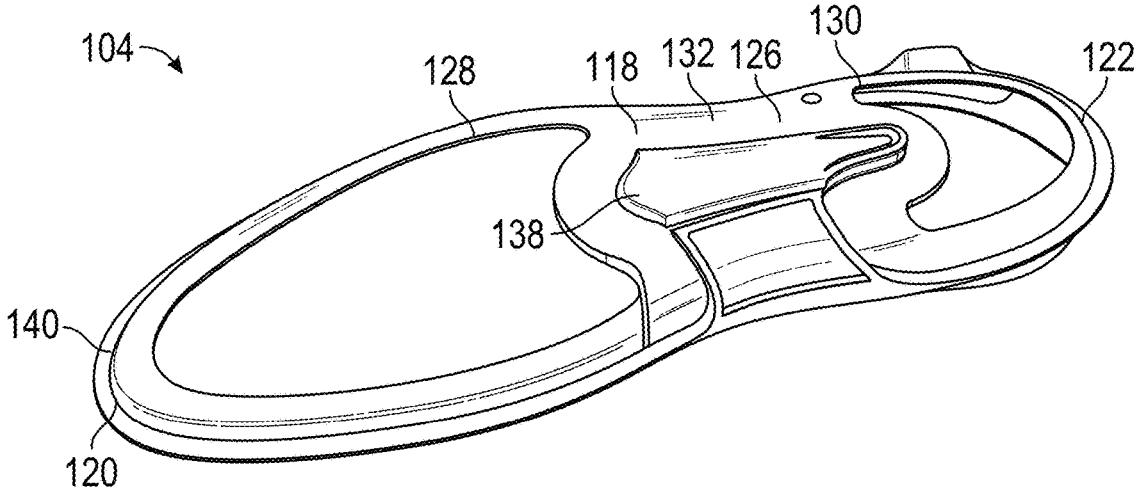
FIG. 5 is a bottom perspective view of the chassis of FIG. 4.

In certain embodiments, and as best illustrated in FIGS. 3-5, the chassis 104 optionally includes at least one aperture extending through the thickness of the chassis 104 between the center region 132 and the toe end 120 and/or between the center region 132 and the heel end 122. In other embodiments, the chassis 104 need not include the at least one aperture. In the embodiment illustrated, the chassis 104 includes a first aperture 128 and a second aperture 130 that each extend through the thickness of the chassis 104. In these embodiments, the center region 132 of the body 118 separates the first aperture 128 from the second aperture 130. In various embodiments, the first aperture 128 is proximate to the toe end 120 of the body 118 and in a forefoot region of the chassis 104 that may be aligned with a ball of the user's foot when the article of footwear 100 is worn. In this embodiment, the second aperture 130 is proximate to the heel end 122 of the body 118 and in a heel region of the chassis 104 that may be aligned with the heel of the user's foot when the article of footwear 100 is worn. In certain aspects, a size of the second aperture 130 is less than a size of the first aperture 128, although it need not be. In various embodiments, a size of the first aperture 128 is greater than a size of the center region 132, and a size of the center region 132 is greater than a size of the second aperture 130, although they need not be in other examples. The particular shape, size, and position of the first aperture 128 and/or the second aperture 130 illustrated in the embodiment of FIGS. 1-20 should not be considered limiting. As a non-limiting example, FIGS. 21-30 illustrate another embodiment of an article of footwear 2100 that includes a chassis 2104 having a differently shaped first aperture 2128 and a differently shaped second aperture 2130. As discussed in detail below, the first aperture 128 and/or the second aperture 130 may receive a portion of the midsole 106 when the chassis 104 is assembled with the midsole 106 to position and orient the chassis 104 relative to the midsole 106.

In some embodiments, and as best illustrated in FIGS. 3, 4, 11, 15, and 18, the center region 132 of the body 118 includes a cored region 134. In certain embodiments, the size of the cored region 134 is less than the size of the center region 132 (e.g., at least a portion of the center region 132 is not the cored region 134), although it need not be in other embodiments. In certain non-limiting embodiments, the cored region 134 may be on the center region 132 of the body 118 such that at least a portion of the cored region 134 is positioned beneath an arch of a wearer's foot when the article of footwear 100 is worn. However, the shape, location, and/or size of the cored region 134 on the center region 132 should not be considered limiting.

Figure 15:
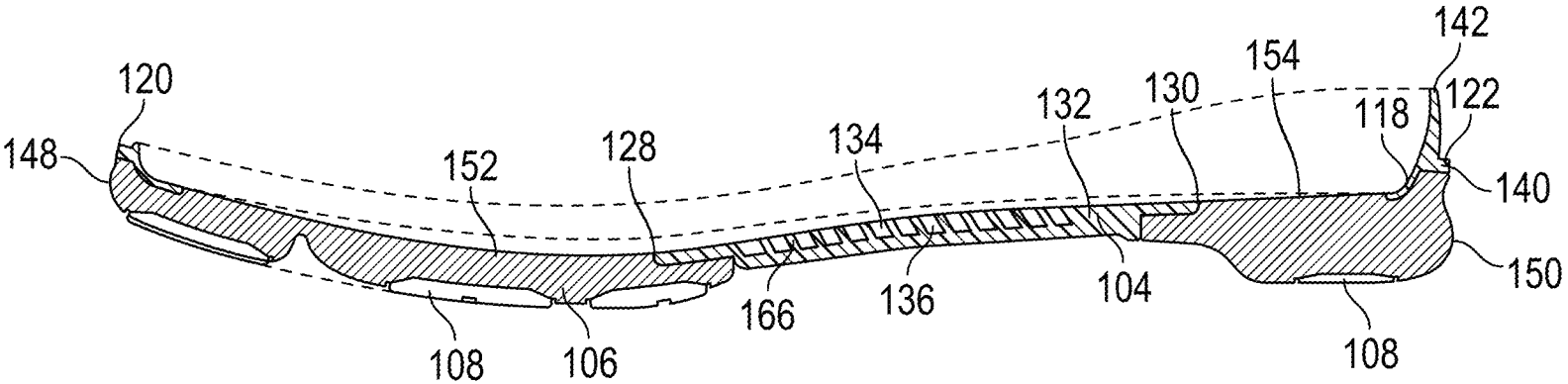
FIG. 15 is a sectional view of the portion of the article of footwear of FIG. 11 taken along line 15-15 in FIG. 12.
Figure 16:
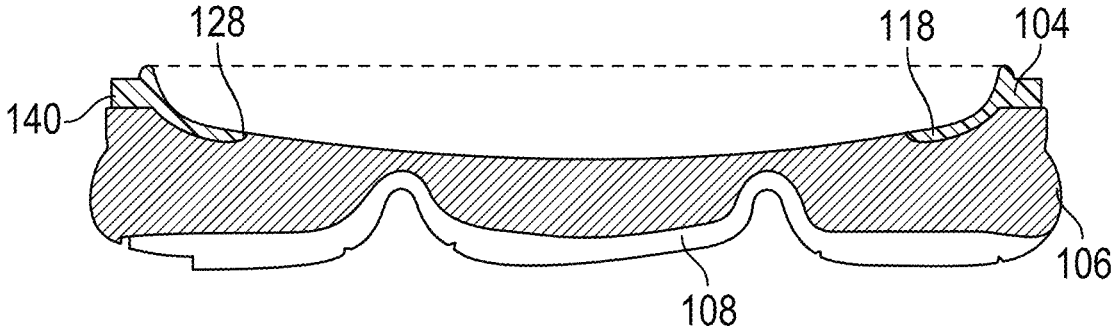
FIG. 16 is a sectional view of the portion of the article of footwear of FIG. 11 taken along line 16-16 in FIG. 12.
Figure 17:
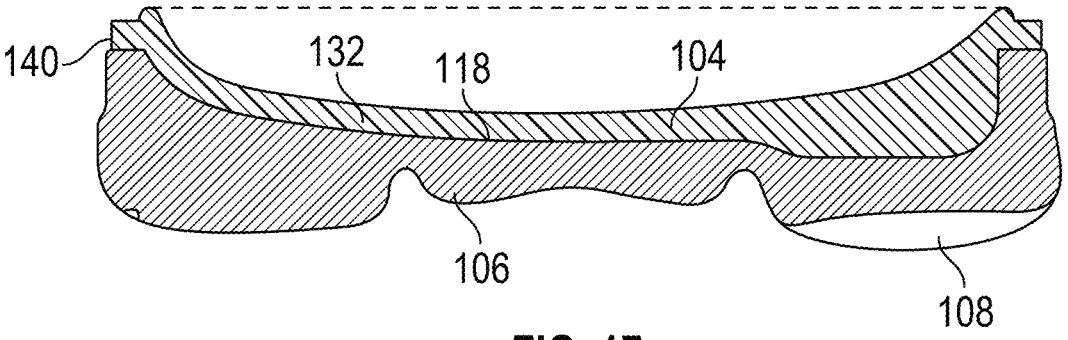
FIG. 17 is a sectional view of the portion of the article of footwear of FIG. 11 taken along line 17-17 in FIG. 12.
Figure 18:
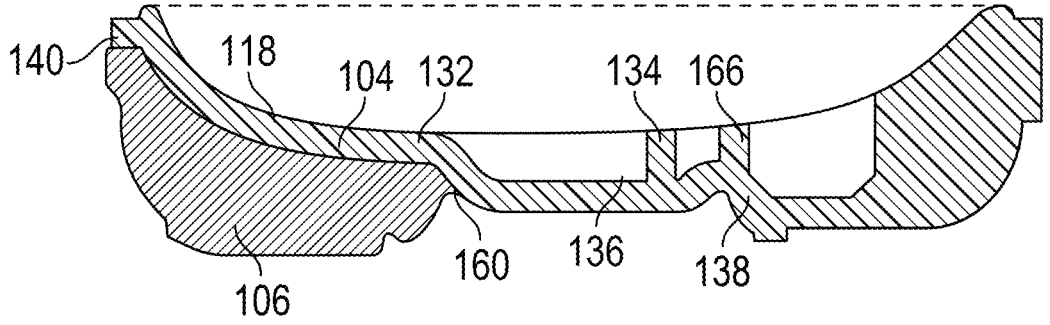
FIG. 18 is a sectional view of the portion of the article of footwear of FIG. 11 taken along line 18-18 in FIG. 12.
Figure 19:
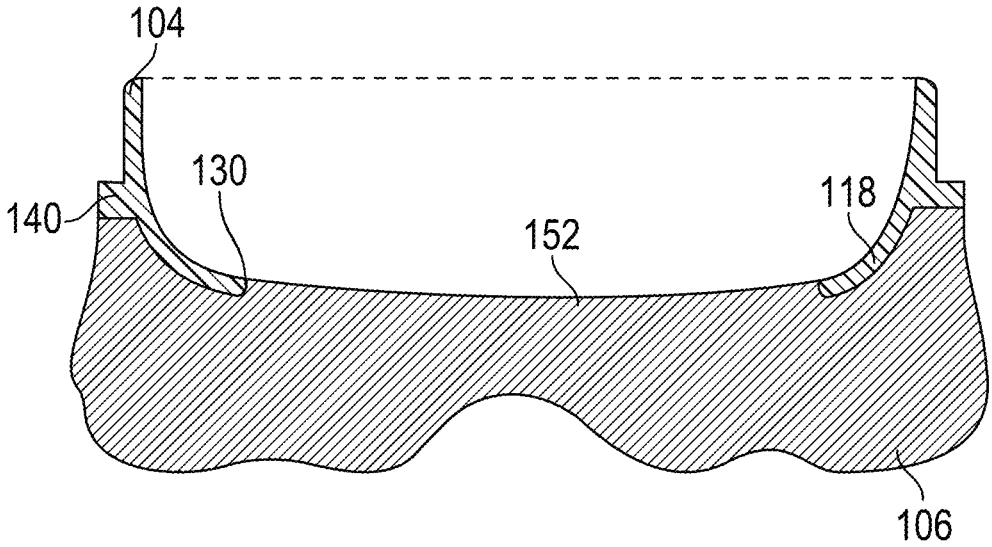
FIG. 19 is a sectional view of the portion of the article of footwear of FIG. 11 taken along line 19-19 in FIG. 12.

The cored region 134 includes a cavity 136 that is defined in the upper surface 124 of the body 118. In some embodiments, and as best illustrated in FIGS. 15 and 18, a depth of the cavity 136 may be less than the thickness of the center region 132 of the body 118. In addition to the cavity 136, the cored region 134 also includes at least one vertical support 166 within the cavity 136. In the embodiment illustrated, the cored region 134 includes a plurality of vertical supports 166 within the cavity. The shape, size, pattern, number, and/or orientation of the vertical support(s) 166 within the cavity 136 should not be considered limiting. Likewise, the shape and/or size of the cavity 136 should not be considered limiting. When included, the cored region 134 with the vertical support(s) 166 may provide improved support and/or stabilization to a wearer when the article of footwear 100 is worn compared to regions that do not include the cored region 134. In various cases, the cored region 134 may also help minimize and/or prevent the article of footwear from bending at the heel region, which may provide improved support and/or stabilization. In some embodiments, the cored region 134 may also provide the improved support and/or stabilization while also reducing the weight of the chassis 104 compared to other articles of footwear providing such support. In other embodiments, the chassis 104 may be constructed from a material that provides sufficient vertical support, and the cored region 134 may be omitted. Moreover, while a single cored region 134 is illustrated, the number of cored regions should not be considered limiting on the disclosure. As a non-limiting example, the chassis 104 may include more than one cored region 134 such as two cored regions or no cored regions.

In some optional examples, and as best illustrated in FIGS. 5, 15, 18, and 20, the center region 132 of the body 118 may include a raised region 138 that extends outwards from the lower surface 126. In various embodiments, the raised region 138 may be aligned with the cored region 134, although it need not be in other embodiments. As such, the shape, size, and/or location of the raised region 138 should not be considered limiting. In certain embodiments, and as discussed in detail below, the raised region 138 may engage an aperture or other corresponding region on the midsole 106 to aid in positioning and/or orienting the chassis 104 relative to the midsole 106.

In various embodiments, the chassis 104 optionally includes a welt region 140 extending outwards from the body 118. In some embodiments, the welt region 140 extends along the entire perimeter of the body 118, although it need not in other embodiments. The welt region 140 of the chassis 104 may be a region of the chassis 104 where the upper 102 is joined with the midsole 106 (see, e.g., FIGS. 1 and 2). Various suitable bonding agents or mechanisms may be provided on or with the welt region 140 to join the chassis 104 with the upper 102 and the midsole 106. As some non-limiting examples, bonding agents or mechanisms may include adhesives, stitching, other chemical fasteners, other mechanical fasteners, and/or other suitable mechanisms or features as desired. In some embodiments, the welt region 140 is visible after joining the upper 102 with the midsole 106, although it need not be in other embodiments. Optionally, the welt region 140 includes a positioning feature 142 that may at least partially overlap a portion of the outer surface 116 of the upper 102. When included, the positioning feature 142 may at least partially orient and position the upper 102 relative to the chassis 104. In the embodiment of FIGS. 1-20, the positioning feature 142 is a projection extending upwards from the body 118; however, various other suitable features or components may be used as positioning features 142 as desired. In other embodiments, the positioning feature 142 may be omitted (see, e.g., FIGS. 21-31).

The midsole 106 of the article of footwear 100 includes an upper surface 144 and a lower surface 146 opposite from the upper surface 144. Similar to the chassis 104, the midsole 106 includes a toe end 148 and a heel end 150. In some embodiments, the lower surface 146 is an outermost surface of the article of footwear 100, and in certain embodiments, at least a portion of the lower surface 146 is a ground-engaging surface of the article of footwear 100.

In various embodiments, and as best illustrated in FIGS. 3, 6, 15, 16, and 19, the midsole 106 includes one or more raised regions extending from the upper surface 144 that selectively engage the one or more apertures of the chassis 104. In various embodiments, the engagement between the one or more raised regions of the midsole 106 with the one or more apertures of the chassis 104 may position and orient the chassis 104 relative to the midsole 106. In the embodiment illustrated, the midsole 106 includes a first raised region 152 and a second raised region 154. In this embodiment, the first raised region 152 is receivable in the first aperture 128 and the second raised region 154 is receivable in the second aperture 130. The first raised region 152 in the first aperture 128 and the second raised region 154 in the second aperture 130 may allow for portions of the wearer's foot to engage the midsole 106 without being obstructed by the chassis 104. In some embodiments, the first raised region 152 is positioned in the first aperture 128 such that the first raised region 152 is flush with the upper surface 124 of the chassis 104. Likewise, in certain embodiments, the second raised region 154 may be positioned in the second aperture 130 such that the second raised region 154 is flush with the upper surface 124 of the chassis 104. In some aspects, the first raised region 152 and the second raised region 154 being flush with the upper surface 124 of the chassis 104 may position and orient the chassis 104 relative to the midsole 106 while also providing a comfortable, continuous surface that supports the wearer's foot.

Figure 6:
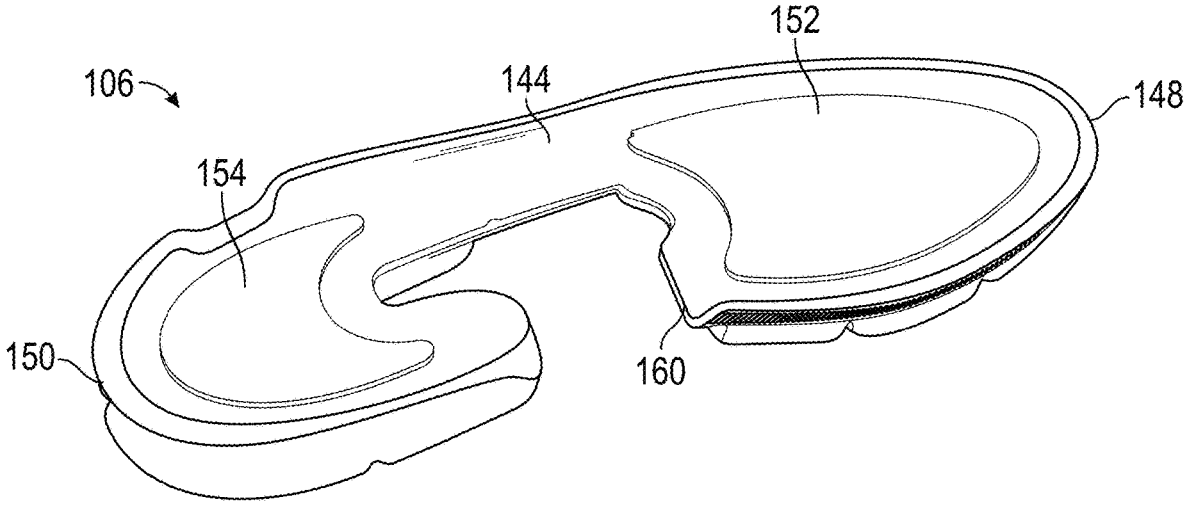
FIG. 6 is a top perspective view of an midsole of the article of footwear of FIG. 1.
Figure 7:
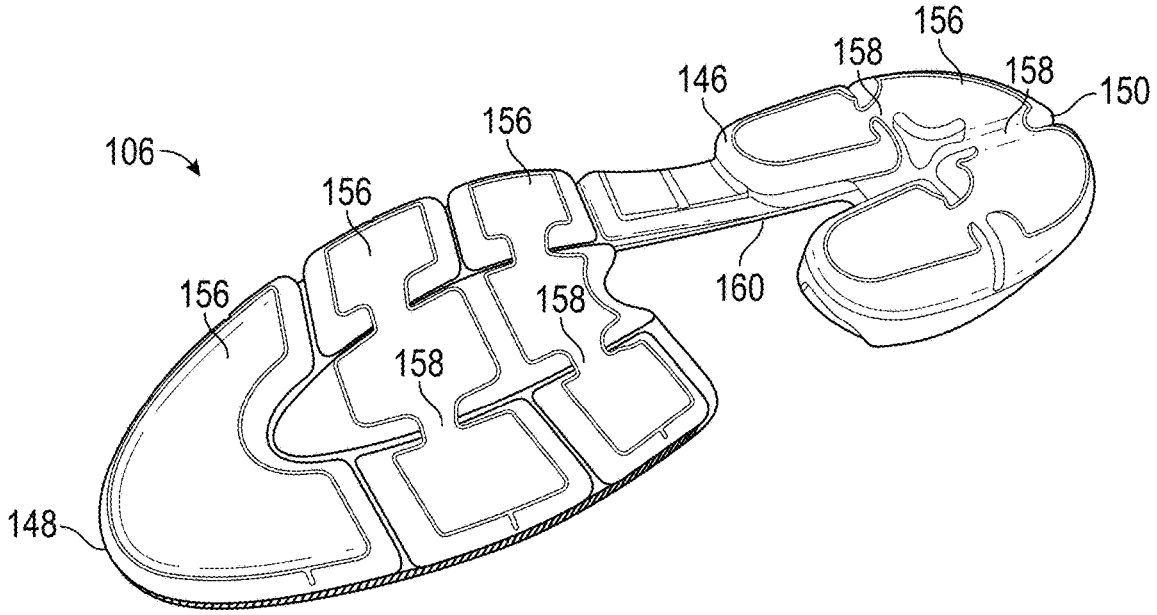
FIG. 7 is a bottom perspective view of the midsole of FIG. 6.
Figure 20:
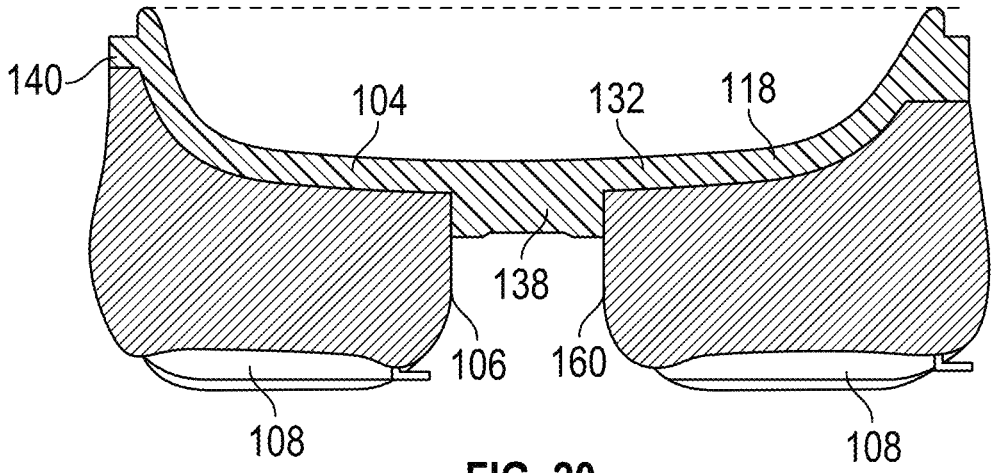
FIG. 20 is a sectional view of the portion of the article of footwear of FIG. 11 taken along line 20-20 in FIG. 12.
Figure 21:
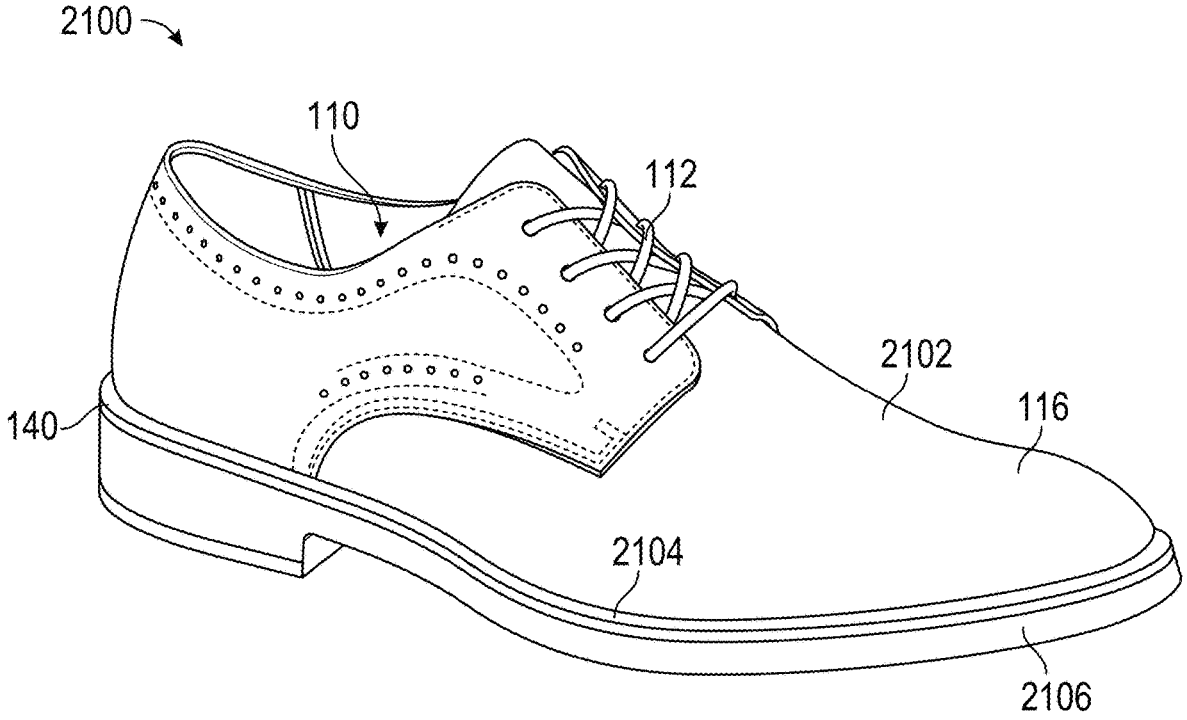
FIG. 21 is a perspective view of an article of footwear according to various embodiments.
Figure 22:
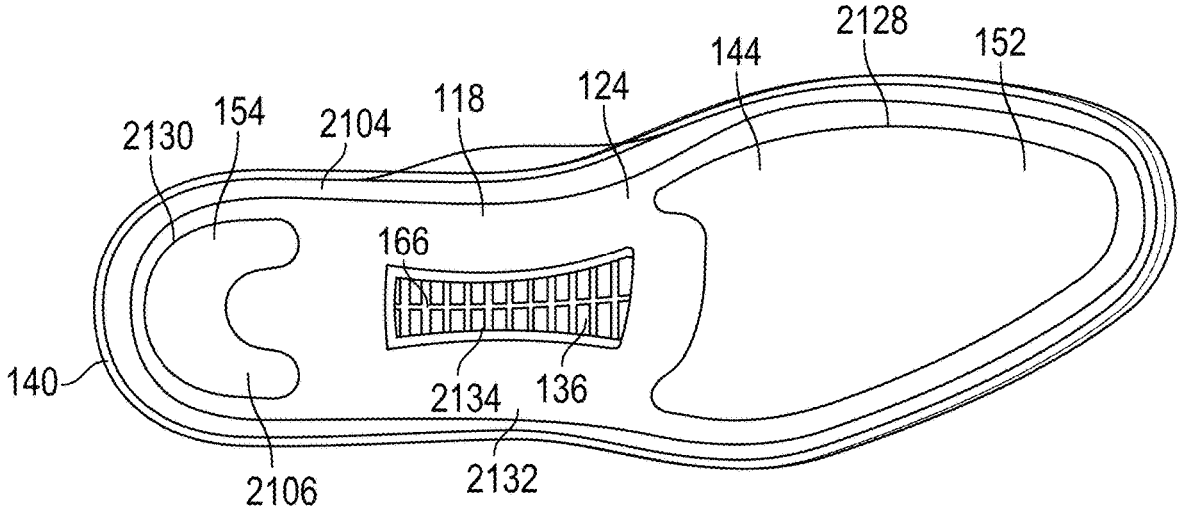
FIG. 22 is a top view of a portion of the article of footwear of FIG. 21.
Figure 23:
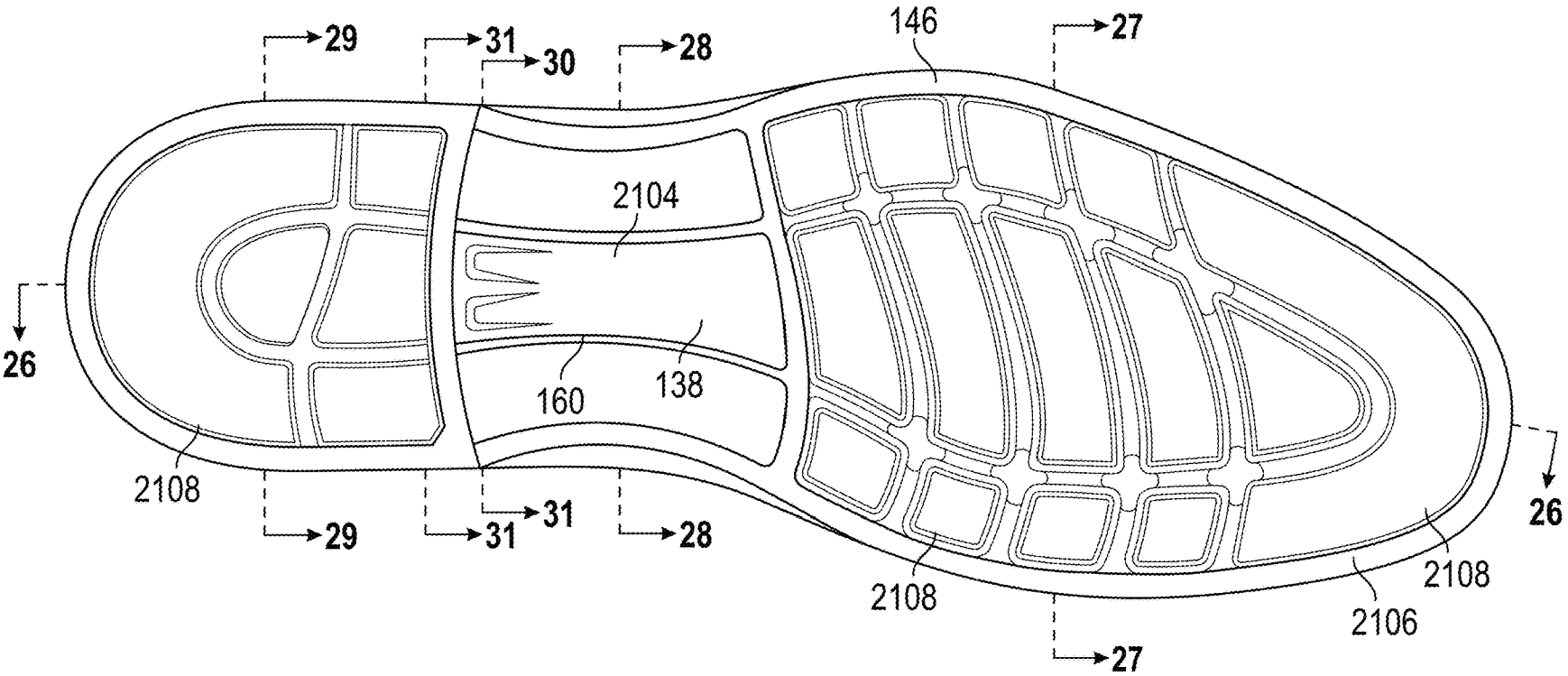
FIG. 23 is a bottom view of the portion of the article of footwear of FIG. 22.
Figure 24:
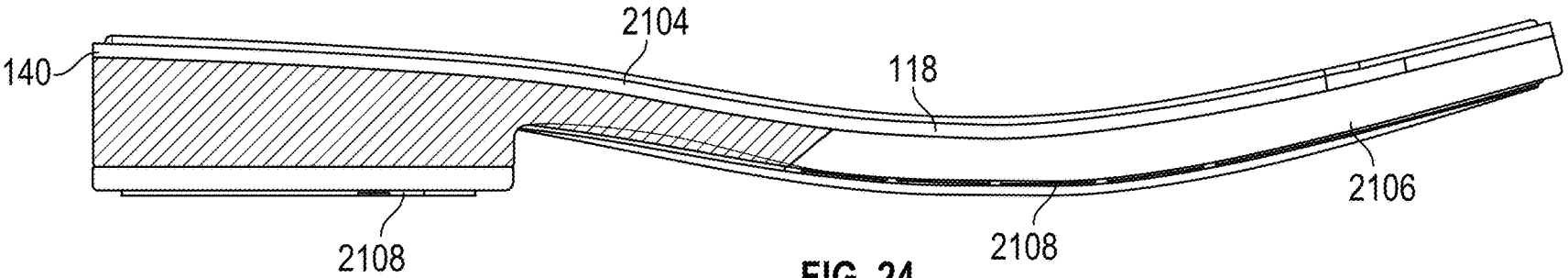
FIG. 24 is a first side view of the portion of the article of footwear of FIG. 22.
Figure 25:
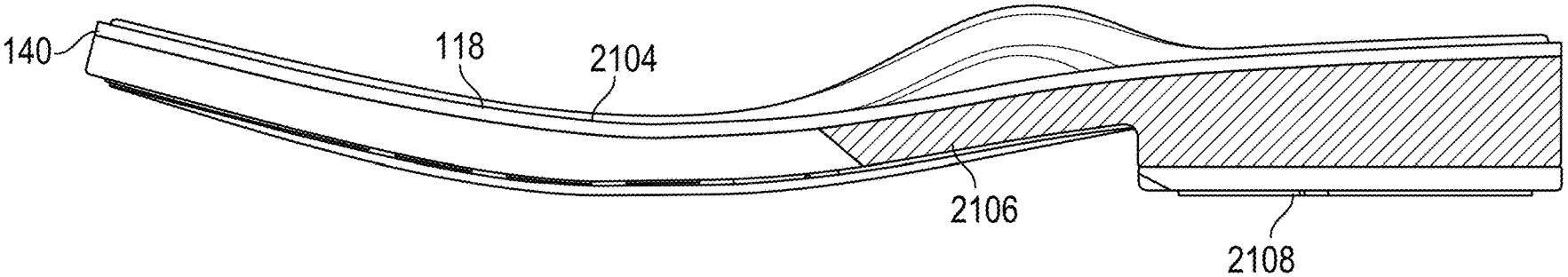
FIG. 25 is a second side view of the portion of the article of footwear of FIG. 22.
Figure 26:
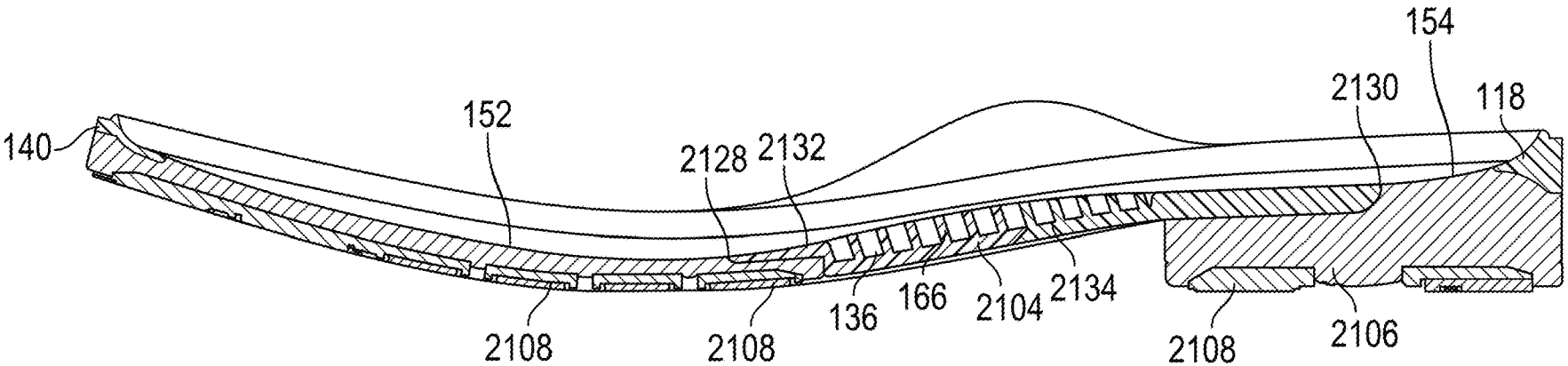
FIG. 26 is a sectional view of the portion of the article of footwear of FIG. 22 taken along line 26-26 in FIG. 23.
Figure 27:
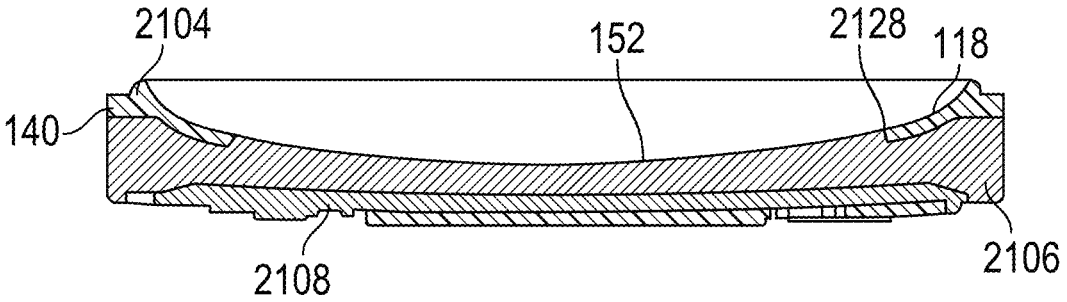
FIG. 27 is a sectional view of the portion of the article of footwear of FIG. 22 taken along line 27-27 in FIG. 23.
Figure 28:
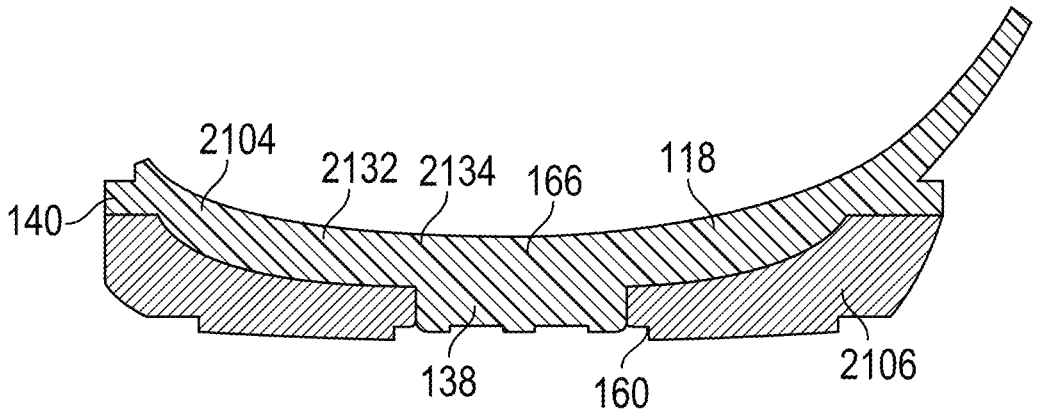
FIG. 28 is a sectional view of the portion of the article of footwear of FIG. 22 taken along line 28-28 in FIG. 23.
Figure 29:
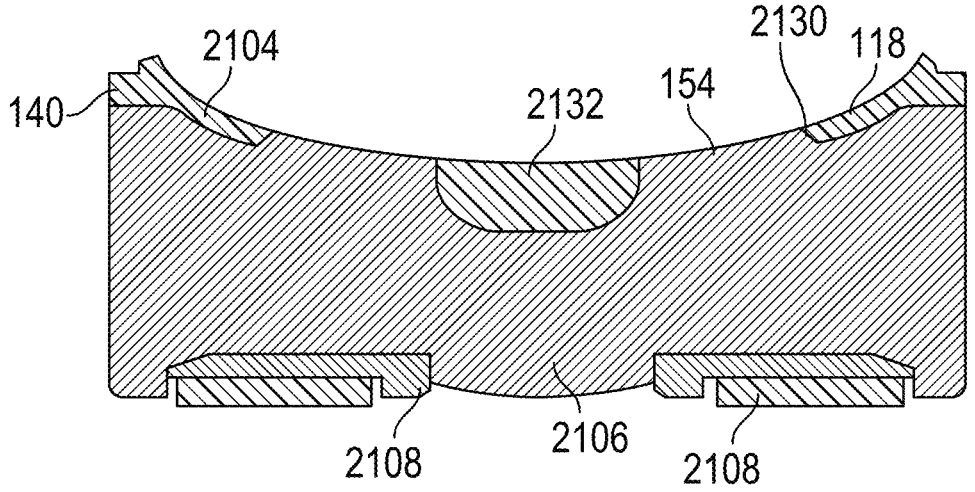
FIG. 29 is a sectional view of the portion of the article of footwear of FIG. 22 taken along line 29-29 in FIG. 23.
Figure 30:
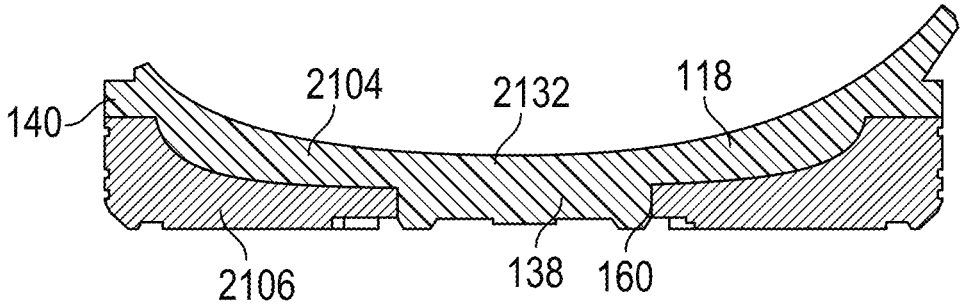
FIG. 30 is a sectional view of the portion of the article of footwear of FIG. 22 taken along line 30-30 in FIG. 23.
Figure 31:
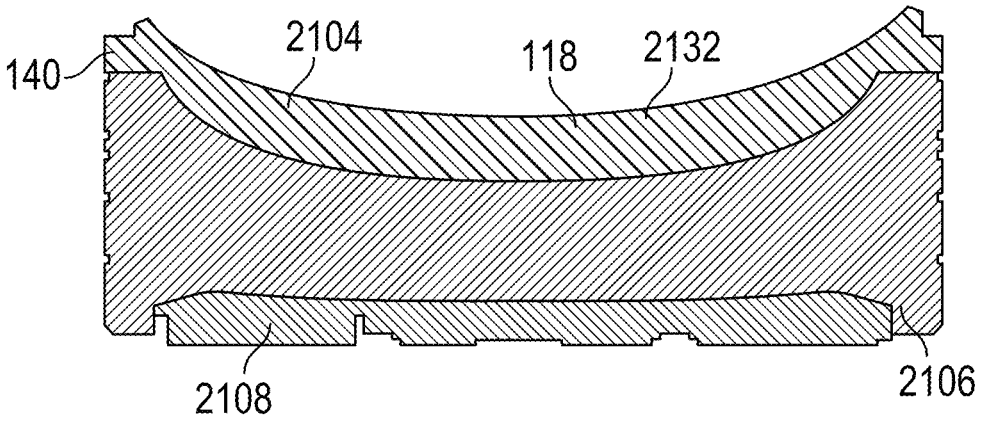
FIG. 31 is a sectional view of the portion of the article of footwear of FIG. 22 taken along line 31-31 in FIG. 23.

Optionally, and as best illustrated in FIGS. 6 and 7, a portion of the midsole 106 between the toe end 148 and the heel end 150 may include an aperture 160 that extends through a thickness of the midsole 106. In some cases, the aperture 160 may have an open perimeter (e.g., does not define a closed shape as illustrated in FIGS. 6 and 7) or a closed perimeter (see, e.g., FIGS. 21-31). When included, the aperture 160 may receive the raised region 138 of the chassis 104 to further position and orient the chassis 104 relative to the midsole 106. In certain embodiments, and as best illustrated in FIGS. 18 and 20, the raised region 138 of the chassis 104 positioned in the aperture 160 may extend below the upper surface 144 of the midsole 106. In various embodiments, the raised region 138 optionally may not extend to the lower surface 146 of the midsole 106 (e.g., the raised region 138 may be offset above the lower surface 146).

As best illustrated in FIG. 7, the lower surface 146 of the midsole 106 optionally may include one or more gripping cavities 156. Optionally, adjacent gripping cavities 156 may be separated by a gripping groove 158. As discussed in detail below, the gripping cavities 156 may receive the outsole 108.

The midsole 106 may be constructed from various materials as desired. In certain embodiments, the midsole 106 may be constructed from a material that is softer than the material of the chassis 104. In various embodiments, the midsole 106 may be constructed from various materials including, but not limited to, polyurethane, leather, various types or rubber, elastomers, EVA, biobased content, biomass, biobased intermediate, bioresins, biopolymers, biobased/renewable chemicals, reclaimed material, post-consumer material, pre-consumer/post-industrial material, combinations thereof, or other suitable materials as desired. In various examples, the midsole 106 has a durometer of from about 30 Asker C to about 90 Asker C, such as from about 45 Asker C to about 75 Asker C, such as from about 50 Asker C, to about 70 Asker C. In various examples, the midsole 106 may have a durometer that is less than that of the chassis 104. The midsole 106 may be formed through various manufacturing techniques such as injection molding, compression molding, molding, or other suitable techniques or combination of techniques as desired.

Figure 8:
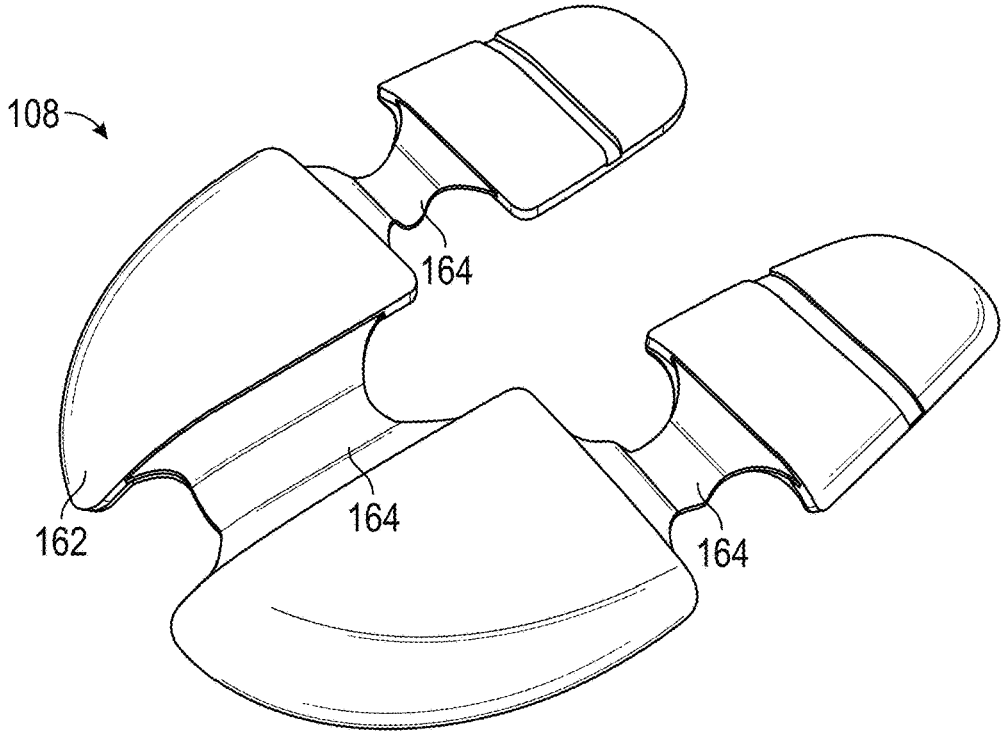
FIG. 8 is a top perspective view of an outsole of the article of footwear of FIG. 1.
Figure 9:
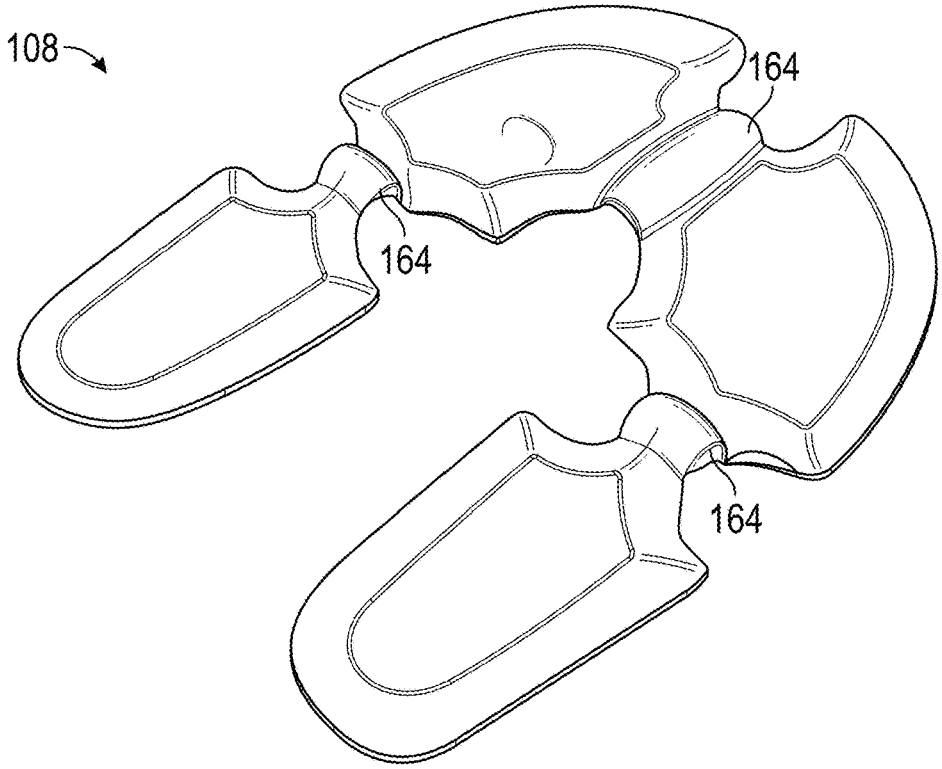
FIG. 9 is a bottom perspective view of the outsole of FIG. 8.
Figure 10:
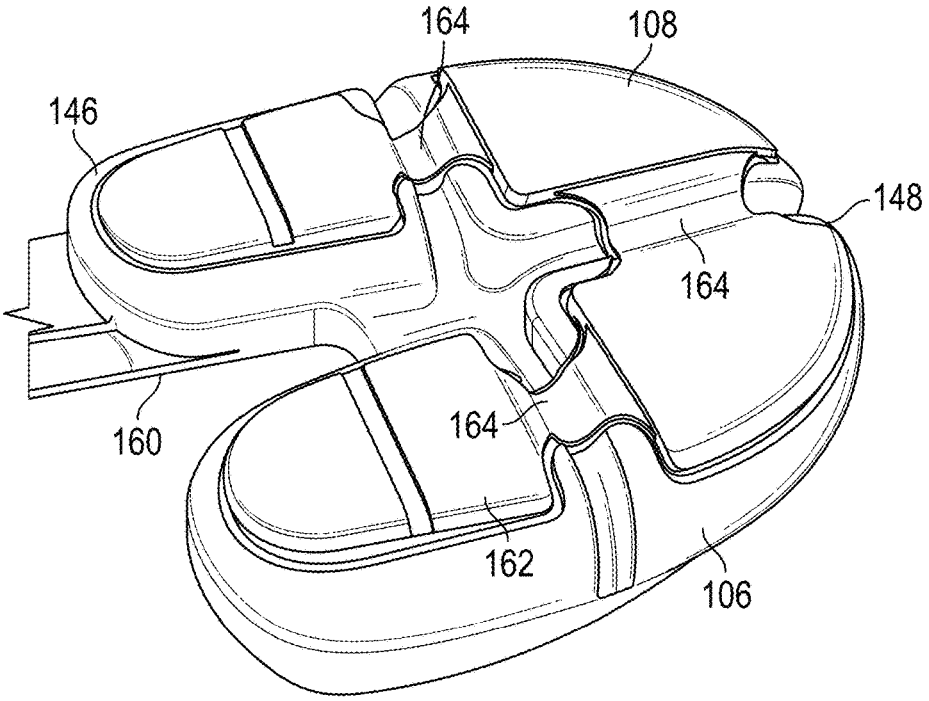
FIG. 10 is a bottom perspective view of the outsole of FIG. 8 assembled with the midsole of FIG. 6.
Figure 11:
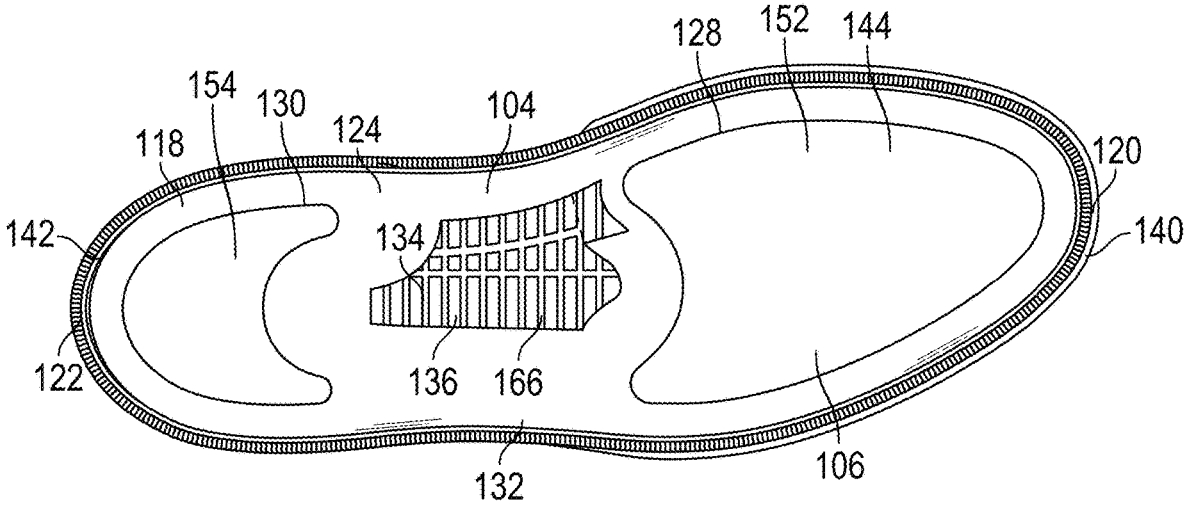
FIG. 11 is top view of a portion of the article of footwear of FIG. 1.
Figure 12:
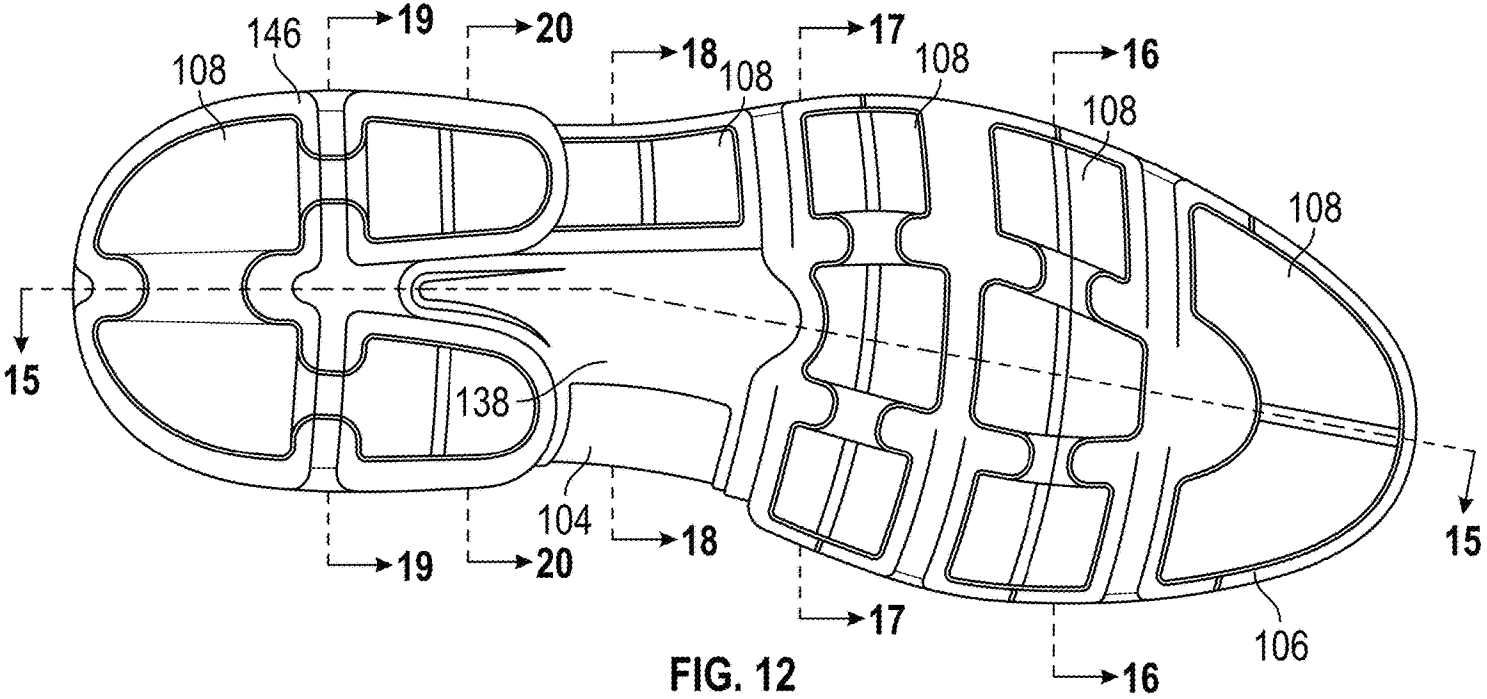
FIG. 12 is a bottom view of the portion of the article of footwear of FIG. 11.
Figure 13:
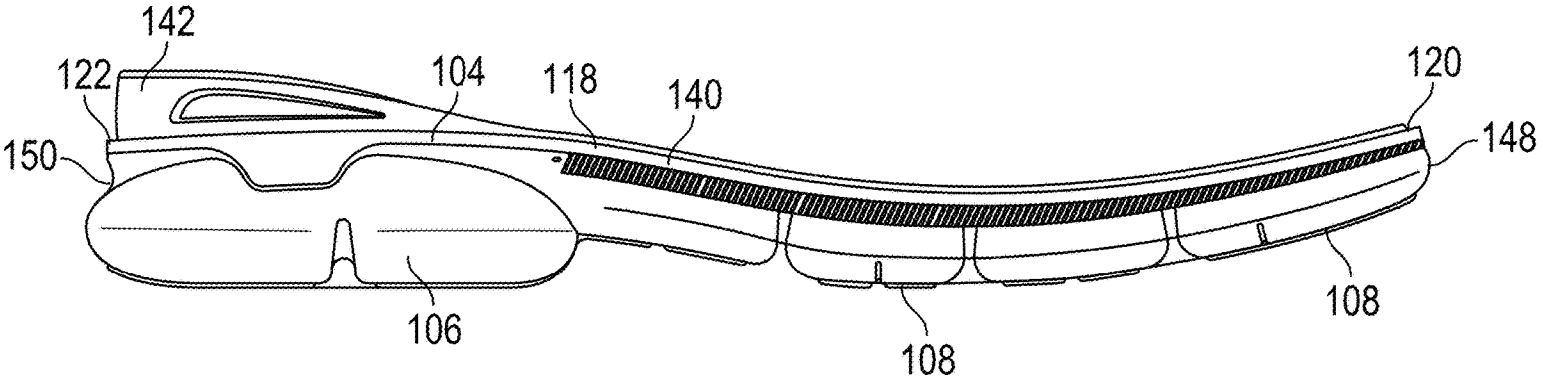
FIG. 13 is a first side view of the portion of the article of footwear of FIG. 11.
Figure 14:
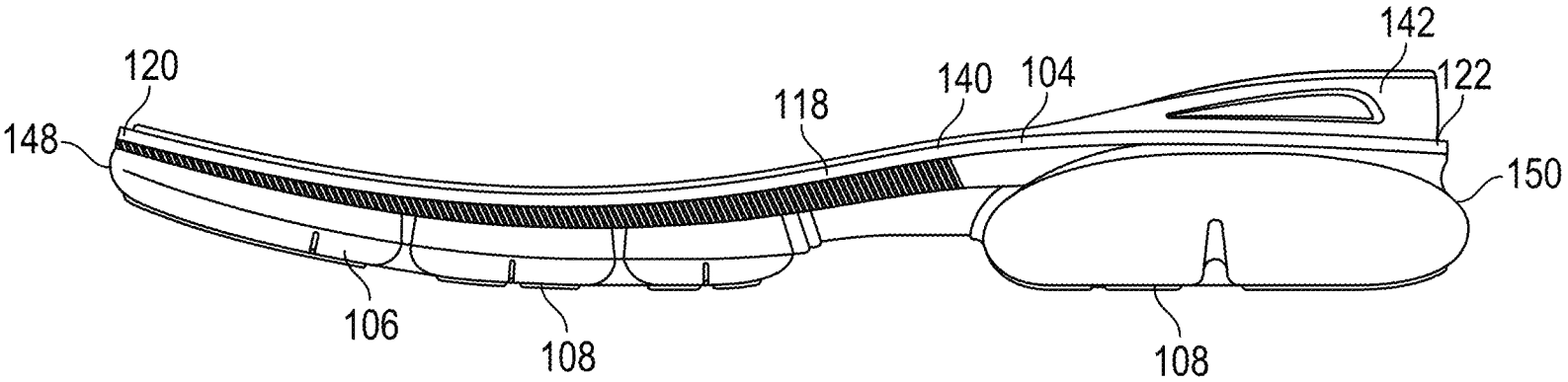
FIG. 14 is a second side view of the portion of the article of footwear of FIG. 11.

As best illustrated in FIGS. 8-10, the outsole 108 may include a gripping surface 162 that may engage the ground when worn by the wearer. The number, location, and/or shape of the outsole 108 should not be considered limiting. The gripping surface 162 may be textured and/or have other surface properties as desired. In certain embodiments, a portion of the outsole 108 is positionable in more than one gripping cavity 156, although it need not in other embodiments. Optionally, the outsole 108 may include one or more ribs 164 that extend in a direction away from the gripping surface 162. The ribs 164 may be positionable in the gripping groove(s) 158 to further position and orient the outsole 108 relative to the midsole 106. The outsole 108 may be joined to the midsole 106 via various suitable mechanisms or devices as desired, including but not limited to adhesives, mechanical fasteners, bonding agents, combinations thereof, or other suitable mechanisms or devices as desired. When the outsole 108 is joined to the midsole 106, the gripping surface 162 may be flush with the lower surface 146 of the midsole 106, although it need not be flush in other embodiments.

FIGS. 21-31 illustrate another embodiment of an article of footwear 2100 with an upper 2102, the chassis 2104, and an midsole 2106. Compared to the upper 102, the upper 2102 has a different shape and is constructed from a different material. The chassis 2104 is substantially similar to the chassis 104 except that the chassis 2104 has a differently shaped first aperture 2128 and a differently shaped second aperture 2130. Compared to the chassis 104, the chassis 2104 also omits the positioning feature 142, and a cored region 2134 of a center region 2132 has a different shape and is provided at a different location compared to the cored region 134 on the center region 132. The midsole 2106 is substantially similar to the midsole 106 except that the lower surface 2146 has a different profile. Similar to the article of footwear 100, the article of footwear 2100 has the outsole 2108, but the shape and location of the portions of the outsole 2108 is different compared to the outsole 108. In addition, the outsole 2108 is a two-layer outsole compared to the outsole 108.

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. An article of footwear comprising: a chassis comprising: a body comprising a toe end, a heel end, a top surface, and a bottom surface, wherein the body defines a perimeter of the chassis, wherein a distance from the top surface to the bottom surface is a thickness of the chassis, and an aperture within the perimeter of the chassis and extending through the thickness of the chassis; and an midsole attached to the chassis, wherein the midsole comprises a top surface and a bottom surface, wherein the bottom surface is an outer surface of the article of footwear that is configured to engage a ground surface when worn by a user, wherein the top surface comprises a raised region, and wherein the raised region of the top surface is received within the aperture of the chassis such that the raised region of the top surface is flush with the top surface of the body.

Illustration 2. The article of footwear of any preceding or subsequent illustrations or combination of illustrations, wherein the midsole comprises at least one of thermoplastic polyurethane, thermoplastic elastomers, carbon fiber, a material fused with carbon fiber, injected plastics, thermoplastic rubbers, latex rubbers, dual density polyurethane, natural rubbers, elastomers, ethylene vinyl acetate (EVA), biobased content, biomass, biobased intermediate, bioresins, biopolymers, biobased and/or renewable chemicals. reclaimed material, post-consumer material, and/or pre-consumer/post-industrial material.

Illustration 3. The article of footwear of any preceding or subsequent illustrations or combination of illustrations, wherein the body comprises a non-uniform thickness along a length of the body from the toe end to the heel end.

Illustration 4. The article of footwear of any preceding or subsequent illustrations or combination of illustrations, wherein the body of the chassis comprises a center region between the toe end and the heel end, and wherein the thickness of the body in the center region is greater than the thickness of the body proximate to the toe end and greater than the thickness of the body proximate to the heel end.

Illustration 5. The article of footwear of any preceding or subsequent illustrations or combination of illustrations, wherein the body further comprises a welt region extending along the perimeter of the chassis, wherein the welt region is configured to join an upper of the article of footwear with the midsole of the article of footwear.

Illustration 6. The article of footwear of any preceding or subsequent illustrations or combination of illustrations, wherein the body of the chassis comprises a center region between the toe end and the heel end, and wherein the center region of the body comprises a cored region, and wherein the cored region comprises a cavity defined in the top surface and at least one vertical support within the cavity.

Illustration 7. The article of footwear of any preceding or subsequent illustrations or combination of illustrations, wherein a depth of the cavity of the cored region in the top surface is less than a thickness of the center region of the body.

Illustration 8. The article of footwear of any preceding or subsequent illustrations or combination of illustrations, wherein the aperture is a forefoot aperture proximate to the toe end of the body, and wherein the chassis further comprises a heel aperture defined in the body proximate to the heel end of the body within the perimeter of the chassis and extending through the thickness of the chassis, wherein a center region of the body separates the forefoot aperture from the heel aperture.

Illustration 9. The article of footwear of any preceding or subsequent illustrations or combination of illustrations, wherein the raised region on the top surface of the midsole is a forefoot raised region, wherein the midsole further comprises a heel raised region, and wherein the heel raised region is received within the heel aperture of the chassis such that the heel raised region of the top surface is flush with the top surface of the body.

Illustration 10. The article of foot wear of any preceding or subsequent illustrations or combination of illustrations, wherein the bottom surface of the midsole further comprises at least one gripping cavity, and wherein the article of footwear further comprises an outsole retained within the at least one gripping cavity.

Illustration 11. An article of footwear comprising a chassis, the chassis comprising: a body comprising a toe end, a heel end, a top surface, and a bottom surface, wherein a distance from the top surface to the bottom surface is a thickness of the chassis, and wherein the body defines a perimeter of the chassis; and an aperture within the perimeter of the chassis and extending through the thickness of the chassis, wherein the body comprises a non-uniform thickness, and wherein the thickness of a center region of the body between the toe end and the heel end is greater than the thickness of the body proximate to the toe end and greater than the thickness of the body proximate to the heel end.

Illustration 12. The article of footwear of any preceding or subsequent illustrations or combination of illustrations, wherein the thickness of the center region of the body is a greatest thickness of the body.

Illustration 13. The article of footwear of any preceding or subsequent illustrations or combination of illustrations, wherein the aperture is a forefoot aperture proximate to the toe end of the body, and wherein the chassis further comprises a heel aperture defined in the body proximate to the heel end of the body within the perimeter of the chassis and extending through the thickness of the chassis, wherein the center region of the body separates the forefoot aperture from the heel aperture.

Illustration 14. The article of footwear of any preceding or subsequent illustrations or combination of illustrations, wherein the body further comprises a welt region extending along the perimeter of the chassis, and wherein the article of footwear further comprises: an upper; and an midsole, wherein the welt region of the body of the chassis joins the upper with the midsole.

Illustration 15. The article of footwear of any preceding or subsequent illustrations or combination of illustrations, wherein the midsole comprises polyurethane.

Illustration 16. The article of footwear of any preceding or subsequent illustrations or combination of illustrations, further comprising: an midsole attached to the chassis, wherein the midsole comprises a top surface and a bottom surface, wherein the bottom surface is an outer surface of the article of footwear that is configured to engage a ground surface when worn by a user, wherein the top surface comprises a raised region, and wherein the raised region of the top surface is received within the aperture of the chassis such that the raised region of the top surface is flush with the top surface of the body.

Illustration 17. The article of foot wear of any preceding or subsequent illustrations or combination of illustrations, wherein the bottom surface of the midsole further comprises at least one gripping cavity, and wherein the article of footwear further comprises an outsole retained within the at least one gripping cavity.

Illustration 18. The article of footwear of any preceding or subsequent illustrations or combination of illustrations, wherein the center region of the body comprises a cored region, and wherein the cored region comprises a cavity defined in the top surface and at least one vertical support within the cavity.

Illustration 19. The article of footwear of any preceding or subsequent illustrations or combination of illustrations, wherein a depth of the cavity of the cored region in the top surface is less than the thickness of the center region of the body.

Illustration 20. The article of footwear of any preceding or subsequent illustrations or combination of illustrations, wherein the cored region comprises a plurality of vertical supports within the cavity.

Illustration 21. An article of footwear comprising a chassis, the chassis comprising a body, the body of the chassis comprising: a toe end; a heel end; a center region between the toe end and the heel end; a top surface; and a bottom surface, wherein a distance from the top surface to the bottom surface is a thickness of the chassis, wherein the body defines a perimeter of the chassis, and wherein the center region of the body comprises a cored region, the cored region comprising a cavity defined in the top surface and at least one vertical support within the cavity.

Illustration 22. The article of footwear of any preceding or subsequent illustrations or combination of illustrations, wherein the chassis further comprises an aperture within the perimeter of the chassis, and wherein the aperture extends through the thickness of the chassis.

Illustration 23. The article of footwear of any preceding or subsequent illustrations or combination of illustrations, wherein the aperture is a forefoot aperture proximate to the toe end of the body, and wherein the chassis further comprises a heel aperture defined in the body proximate to the heel end of the body within the perimeter of the chassis and extending through the thickness of the chassis, wherein the center region of the body separates the forefoot aperture from the heel aperture.

Illustration 24. The article of footwear of any preceding or subsequent illustrations or combination of illustrations, further comprising: an midsole attached to the chassis, wherein the midsole comprises a top surface and a bottom surface, wherein the bottom surface is an outer surface of the article of footwear that is configured to engage a ground surface when worn by a user, wherein the top surface comprises a raised region, and wherein the raised region of the top surface is received within the aperture of the chassis such that the raised region of the top surface is flush with the top surface of the body.

Illustration 25. The article of footwear of any preceding or subsequent illustrations or combination of illustrations, wherein the bottom surface of the midsole further comprises at least one gripping cavity, and wherein the article of footwear further comprises an outsole retained within the at least one gripping cavity.

Illustration 26. The article of footwear of any preceding or subsequent illustrations or combination of illustrations, wherein the midsole comprises polyurethane.

Illustration 27. The article of footwear of any preceding or subsequent illustrations or combination of illustrations, wherein the body comprises a non-uniform thickness.

Illustration 28. The article of footwear of any preceding or subsequent illustrations or combination of illustrations, wherein the thickness of the center region of the body is greater than the thickness of the body proximate to the toe end and greater than the thickness of the body proximate to the heel end.

Illustration 29. The article of footwear of any preceding or subsequent illustrations or combination of illustrations, wherein the cored region comprises a plurality of vertical supports within the cavity.

Illustration 30. The article of footwear of any preceding or subsequent illustrations or combination of illustrations, wherein the body further comprises a welt region extending along the perimeter of the chassis, wherein the welt region is configured to join an upper of the article of footwear with an midsole of the article of footwear.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed is:

1. An article of footwear comprising:

a chassis comprising a toe end, a heel end, a top surface, and a bottom surface, wherein a distance from the top surface to the bottom surface is a thickness of the chassis, wherein the chassis defines an aperture within a perimeter of the chassis which extends through the thickness of the chassis, and wherein the chassis is a one-piece construction; and a midsole attached to the chassis, wherein the midsole comprises a top surface and a bottom surface, wherein the bottom surface is an outermost bottom surface of the article of footwear, wherein the top surface comprises a raised region, and wherein the raised region of the top surface is received within the aperture of the chassis such that the raised region of the top surface is flush with the top surface of the chassis, and wherein the midsole is a one-piece construction, wherein the chassis comprises a center region between the toe end and the heel end, and wherein the center region of the chassis comprises a cored region, and wherein the cored region comprises a cavity defined in the top surface of the chassis and at least one vertical support within the cavity, wherein a thickness of the cavity of the cored region is less than the thickness of the chassis.

2. The article of footwear of claim 1, wherein the chassis comprises a non-uniform thickness along a length of the chassis from the toe end to the heel end.

3. The article of footwear of claim 2, wherein the thickness of the chassis in the center region is (i) greater than the thickness of the chassis in a region proximate to the toe end and (ii) greater than the thickness of the chassis in a region proximate to the heel end.

4. The article of footwear of claim 1, wherein the chassis further comprises a welt region extending along the perimeter of the chassis, wherein the welt region is configured to join an upper of the article of footwear with the midsole of the article of footwear.

5. The article of footwear of claim 1, wherein the aperture is a forefoot aperture defined proximate to the toe end of the chassis, and wherein the chassis further defines a heel aperture proximate to the heel end of the chassis within the perimeter of the chassis and extending through the thickness of the chassis, wherein a center region of the chassis separates the forefoot aperture from the heel aperture.

6. The article of foot wear of claim 1, wherein the bottom surface of the midsole further comprises at least one gripping cavity, and wherein the article of footwear further comprises an outsole retained within the at least one gripping cavity.

7. An article of footwear comprising a chassis, the chassis comprising a toe end, a heel end, a top surface, and a bottom surface, wherein a distance from the top surface to the bottom surface is a thickness of the chassis, wherein the chassis defines an aperture within a perimeter of the chassis which extends through the thickness of the chassis, wherein the chassis comprises a non-uniform thickness, and wherein the thickness of a center region of the chassis between the toe end and the heel end is greater than the thickness of the chassis proximate to the toe end and greater than the thickness of the chassis proximate to the heel end, and wherein the chassis is a one-piece construction, wherein the article of footwear further comprises:

a midsole attached to the chassis, wherein the midsole comprises a top surface and a bottom surface, wherein the bottom surface is an outermost bottom surface of the article of, wherein the top surface comprises a raised region, wherein the raised region of the top surface is received within the aperture of the chassis such that the raised region of the top surface is flush with the top surface of the chassis, and wherein the bottom surface of the midsole further comprises at least one gripping cavity, and wherein the article of footwear further comprises an outsole retained within the at least one gripping cavity.

8. The article of footwear of claim 7, wherein the thickness of the center region of the chassis is a greatest thickness of the chassis.

9. The article of footwear of claim 7, wherein the aperture is a forefoot aperture proximate to the toe end of the chassis, and wherein the chassis further defines a heel aperture proximate to the heel end of the chassis, within the perimeter of the chassis, and extending through the thickness of the chassis, wherein the center region of the chassis separates the forefoot aperture from the heel aperture.

10. The article of footwear of claim 7, wherein the chassis further comprises a welt region extending along the perimeter of the chassis, and wherein the article of footwear further comprises:

an upper; and a midsole, wherein the welt region of the body of the chassis joins the upper with the midsole.

11. The article of footwear of claim 7, wherein the center region of the chassis comprises a cored region, and wherein the cored region comprises a cavity defined in the top surface and at least one vertical support within the cavity.

12. An article of footwear comprising a chassis, the chassis comprising:

a toe end;

a heel end;

a center region between the toe end and the heel end;

a top surface; and a bottom surface, wherein a distance from the top surface to the bottom surface is a thickness of the chassis, wherein the chassis is a one-piece construction, wherein the body defines a perimeter of the chassis, and wherein the center region of the chassis comprises a cored region, the cored region comprising a cavity defined in the top surface and at least one vertical support within the cavity, wherein the cavity comprises a cavity surface recessed relative to the top surface and the at least one vertical support extends from the cavity surface, and wherein a thickness of the cavity is less than the thickness of the chassis and such that the cavity does not extend through the thickness of the chassis.

13. The article of footwear of claim 12, wherein the chassis further comprises an aperture within the perimeter of the chassis, and wherein the aperture extends through the thickness of the chassis.

14. The article of footwear of claim 13, wherein the aperture is a forefoot aperture proximate to the toe end of the chassis, and wherein the chassis further comprises a heel aperture defined in the chassis proximate to the heel end of the chassis, within the perimeter of the chassis, and extending through the thickness of the chassis, wherein the center region of the chassis separates the forefoot aperture from the heel aperture.

15. The article of footwear of claim 13, further comprising:

a midsole attached to the chassis, wherein the midsole comprises a top surface and a bottom surface, wherein the bottom surface is an outermost bottom surface of the article of, wherein the top surface comprises a raised region, and wherein the raised region of the top surface is received within the aperture of the chassis such that the raised region of the top surface is flush with the top surface of the chassis.

16. The article of footwear of claim 12, wherein the chassis comprises a non-uniform thickness.

17. The article of footwear of claim 12, wherein the cored region comprises a plurality of vertical supports within the cavity.

18. An article of footwear comprising:

a chassis comprising a toe end, a heel end, a top surface, and a bottom surface, wherein a distance from the top surface to the bottom surface is a thickness of the chassis, wherein the chassis defines an aperture within a perimeter of the chassis which extends through the thickness of the chassis, and wherein the chassis is a one-piece construction; and a midsole attached to the chassis, wherein the midsole comprises a top surface and a bottom surface, wherein the bottom surface is an outermost bottom surface of the article of footwear, wherein the top surface comprises a raised region, and wherein the raised region of the top surface is received within the aperture of the chassis such that the raised region of the top surface is flush with the top surface of the chassis, and wherein the midsole is a one-piece construction, wherein the bottom surface of the midsole further comprises at least one gripping cavity, and wherein the article of footwear further comprises an outsole retained within the at least one gripping cavity.

19. An article of footwear comprising a chassis, the chassis comprising a toe end, a heel end, a top surface, and a bottom surface, wherein a distance from the top surface to the bottom surface is a thickness of the chassis, wherein the chassis defines an aperture within a perimeter of the chassis which extends through the thickness of the chassis, wherein the chassis comprises a non-uniform thickness, and wherein the thickness of a center region of the chassis between the toe end and the heel end is greater than the thickness of the chassis proximate to the toe end and greater than the thickness of the chassis proximate to the heel end, wherein the chassis is a one-piece construction, and wherein the center region of the chassis comprises a cored region, and wherein the cored region comprises a cavity defined in the top surface and at least one vertical support within the cavity.

* * * * *